US007667577B2

(12) United States Patent
Piccolo, III et al.

(10) Patent No.: US 7,667,577 B2
(45) Date of Patent: Feb. 23, 2010

(54) TUNING ALGORITHM FOR CLOCK SOURCE FREQUENCY DRIFT

(75) Inventors: Joseph Piccolo, III, Fitzwilliam, NH (US); Laurent Veilleux, Lachine (CA); Maxime Fortin, La Prairie (CA); Daniel Lauzon, Lachine (CA)

(73) Assignee: SimplexGrinnell LP, Westminster, MA (US)

( * ) Notice: Subject to any disclaimer, the term of this patent is extended or adjusted under 35 U.S.C. 154(b) by 311 days.

(21) Appl. No.: 11/999,593

(22) Filed: Dec. 6, 2007

(65) Prior Publication Data

US 2009/0146801 A1 Jun. 11, 2009

(51) Int. Cl.
*G08B 3/00* (2006.01)

(52) U.S. Cl. ..... 340/309.16; 340/691.1; 340/691.2; 340/815.4; 340/815.52

(58) Field of Classification Search ..... 340/309.16, 340/506, 691.1, 691.2, 691.3, 815.4, 815.46, 340/815.52, 815.75

See application file for complete search history.

(56) References Cited

U.S. PATENT DOCUMENTS

| | | | | |
|---|---|---|---|---|
| 5,659,287 | A * | 8/1997 | Donati et al. | 340/331 |
| 6,693,532 | B2 * | 2/2004 | Capowski et al. | 340/506 |
| 6,816,068 | B2 * | 11/2004 | McCuen et al. | 340/506 |
| 7,091,847 | B2 * | 8/2006 | Capowski et al. | 340/506 |
| 7,382,245 | B2 * | 6/2008 | Girouard | 340/511 |
| 2005/0200472 | A1 * | 9/2005 | Curran et al. | 340/506 |

* cited by examiner

*Primary Examiner*—Toan N Pham

(57) ABSTRACT

An emergency evacuation and fire safety system has a plurality of signal devices. The clock source frequencies are tuned using the method and system such that the signals flash in synchronization continuously at a preset flashing interval upon detecting an alarm condition. A synchronization signal including a calibrated time position is broadcast at each predetermined time interval to all notification appliances. A time difference is computed between a local time position and the received calibrated time position by each of the notification appliances at each predetermined time interval and tuning the flashing of each of the one or more notification appliances by adjusting the preset flashing interval based on the computed time difference by each of the one or more associated notification appliances.

20 Claims, 8 Drawing Sheets

TUNING ALGORITHM FOR CLOCK SOURCE FREQUENCY DRIFT

FIELD OF TECHNOLOGY

This disclosure relates generally to clock sources, more specifically, the subject matter relates to a method and system for tuning clock source frequency drift due to base frequency imprecision, operating temperature, and aging.

BACKGROUND

Currently, there is a tremendous need for integrated and supervised emergency evacuation and fire safety systems. With improvements in technology, oversight agencies have modified the code of standards for implementing and maintaining emergency evacuation and fire safety systems to be more demanding.

For example, the Underwriters Laboratories (UL) has implemented requirements through the standards code UL 1971 that necessitate visual notification appliances, i.e., signaling devices, in the emergency evacuation and fire safety systems to be in sync (i.e., the time difference not exceeding 10 milliseconds between the slowest and the fastest signaling visual devices.)

It is recognized that signal delay occurs as the signal transitions through wiring from one device to another device. Therefore clocks are now common in each visual notification appliance.

Generally, clock sources are subject to two types of clock frequency instabilities: a change in frequency over time (aging drift); and/or a non-linear change in frequency with ambient temperature known (temperature drift). On top of these instabilities, an inherent frequency tolerance exists which affects clock precision.

When each notification appliance has its own clock that is used to pace events, these instabilities may cause notification appliance clocks to lose synchronization with one another; thus notification appliances will not be synchronized, and those viewable from a common point will appear to be flashing randomly with respect to each other.

For example, a typical clock's precision may change as much as 0.7% due to a frequency tolerance of about 0.1%, frequency stability over temperature of about 0.3%, and frequency stability over aging of about 0.3%. This change in precision may result in significant time differences as to when the notification appliances flash.

Conventional safety systems attempted to achieve the required synchronization of the time difference between notification appliances by sending out periodic synchronization signals and ensuring that all notification appliances that are viewable from a common point are on the same signaling line circuit (SLC).

SUMMARY OF THE INVENTION

Unfortunately, conventional safety systems do not allow for synchronization of signals from various signaling line circuits (SLC), therefore the designer of the safety systems is limited in the best way to lay out the system and meet the requirements of UL 1971. For example, it may be desirable to place two notification appliances that are simultaneously viewable from a common point onto two different NACs. Furthermore, the systems do not compensate for resonator imprecision and frequency drift caused by aging and temperature gradients.

In contrast to the above-described conventional system and method, the safety system and method of synchronizing of the signals allows for notification appliances from various notification appliance circuits (NACs), also known as signaling line circuits (SLCs), to be placed in viewing distance of each other. Furthermore, the system and method of tuning the notification appliances uses a method that compensates for resonator imprecision and frequency drift caused by aging and temperature gradients.

One embodiment of the method for tuning clock source frequency drift of a notification appliance in an emergency evacuation and fire safety system includes initiating the notification appliance to flash substantially continuously at a preset flashing interval upon detecting an alarm condition. The notification appliance is coupled to a controlling device that periodically broadcasts a synchronization signal including a calibrated time at a calibration time interval to the notification appliance. Upon detecting the alarm condition, the device is turned on by the system controller and activates its visual appliance (i.e., strobe) with a preset flashing interval that is substantially less than the calibration time interval.

In this embodiment, a time difference is computed between an actual time and the received calibrated time for the notification appliance substantially at each predetermined time interval. The flashing of the notification appliance is tuned by adjusting the local timing of the notification appliance and therefore the preset flashing interval based on the computed time difference of the notification appliance.

In an embodiment, the alarm condition is detected by a device in communication with the controlling device.

In an embodiment, the preset flashing interval is approximately 1 second. The predetermined time interval is approximately 4 seconds.

In an embodiment, the notification appliance is a plurality of notification appliances and the controlling device is a plurality of notification appliance circuit (NAC) drivers connected to a master controller, each NAC driver having at least one notification appliance.

In at least one embodiment, the system has three phases: a coarse adjustment phase, a fine adjustment phase and a regular adjustment phase. During the coarse adjustment phase, coarse adjustments are made to the preset flashing interval if the computed time difference between the actual time and the received calibrated time exceeds a deviation time threshold. During the fine adjustment phase, fine adjustments are made to the preset flashing interval during each of a predefined number (e.g., twenty) of calibration frames. During the regular adjustment phase, regular adjustments are made to the preset flashing interval during each calibration frame when an alarm condition is present.

In an embodiment, the deviation threshold time is approximately one time period, defined as a tick.

In an embodiment, the notification appliances are selected from the group consisting of a visual-only device, an audible/visual device, and a speaker/visual device. In addition, notification appliances may be wall-mounted or ceiling-mounted.

In at least one embodiment of the invention, a notification appliance has a signal controller having a clock. The notification appliance receives a synchronization signal including a calibrated time position from a controlling device. At regular intervals (the calibration interval), the notification appliance computes the difference between an actual time position of the clock maintained locally at the notification appliance and the received calibrated time position. The notification appliance adjusts its flash interval based on the computed time difference.

In an embodiment, an emergency evacuation and fire safety system has a master controller and a detector in communication with the master controller. The system has at least one notification appliance circuit driver in communication with the master controller. Each notification appliance circuit driver has a notification appliance circuit controller having a calibrated time position for sending a synchronizing time message including a calibrated time position periodically at a predetermined time interval. There are at least two notification appliances. Each notification appliance unit includes a signal controller having a clock and a mechanism for receiving a synchronization signal including a calibrated time position from the controlling device. Each notification appliance has a mechanism for computing a time difference between an actual time position of its own clock and the received calibrated time position from the controlling device at each predetermined time interval. Each notification appliance adjusts the preset flashing interval based on the computed time difference. Each notification appliance has an indicating device adapted to notify persons when the notification appliance receives an alarm condition from the controlling device.

In an embodiment, there are at least two notification appliance circuit drivers. Each notification appliance circuit driver has at least two notification appliances.

In an embodiment, a synchronizing signal which includes a time position is broadcast periodically at a predetermined calibration time interval to all notification appliances allowing the latter to adjust their local time reference (i.e., the time with respect to the notification appliance). This time position or timestamp allows the device to determine its current position within the calibration frame. This synchronization poll is broadcast in all operation modes i.e. standby or active modes.

In another embodiment of the subject matter, a method for tuning clock source frequency drift of one or more notification appliances in an emergency evacuation and fire safety system includes initiating each of the one or more notification appliances to flash substantially continuously at a flashing interval when an alarm condition is detected by the initiating device. According to an embodiment of the present subject matter, the preset flashing interval is substantially shorter than the calibration time interval. The method further includes computing an adjustment value based on a time difference between the "local" time (i.e., the time with respect to the notification appliance) and a timestamp received at regular intervals (the calibration interval). The flashing of each notification appliance is tuned by adjusting the flashing interval according to the computed adjustment value.

BRIEF DESCRIPTION OF THE DRAWINGS

The accompanying figures where like reference numerals refer to identical or functionally similar elements throughout the separate views and which together with the detailed description below are incorporated in and form part of the specification, serve to further illustrate various embodiments and to explain various principles and advantages all in accordance with the subject matter.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present subject matter. Also, some of the given values have been rounded for illustrative purposes but should not hinder the comprehension of this embodiment by skilled artisans.

DETAILED DESCRIPTION

The present invention allows notification appliances from various notification appliance circuits (NACs) to flash in synchronization with each other. Thus, they can be placed at locations that can be viewed from a common point. Furthermore, the present invention uses a method that compensates for frequency tolerance and frequency drift caused by, for example, aging and temperature gradients.

Figure 1:
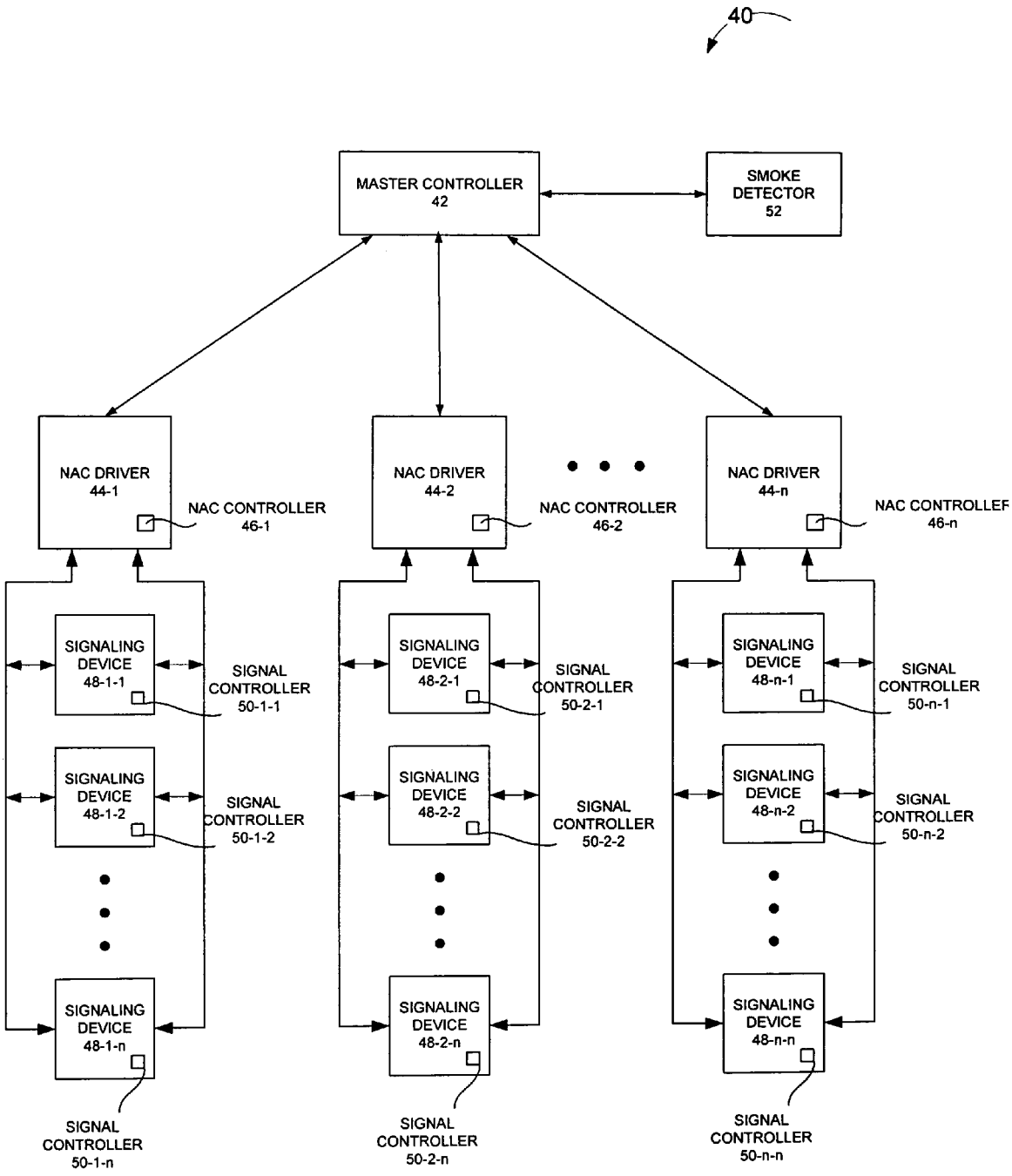
FIG. 1 is a block diagram of an emergency evacuation and fire safety system, in accordance with an embodiment of the present subject matter.

FIG. 1 is a block diagram of an exemplary emergency evacuation and fire safety system 40. The system 40 includes a master controller 42, e.g., a fire alarm control panel, communicating with one or more notification appliance circuits (NACs) via respective NAC drivers 44-1 through **44-*n*. The master controller 42 enables the emergency evacuation and fire safety system 40** in alarm condition in case of fire detection.

In addition, the system 40 has at least one hazard detector 52 that may detect, for example, any or all of smoke, heat, fire or other hazardous conditions and consequently trigger the alarm of the system 40.

Each NAC driver has an associated NAC controller 46-1 through **46-*n*. One or more notification appliances may be associated with each NAC driver 44-1 through 44-*n*, e.g., notification appliances 48-1-1 through 48-1-*n* are associated with the NAC driver 44-1; notification appliances 48-2-1 through 48-2-*n* are associated with the NAC driver 44-2, etc. Each notification appliance 48-*n*-*n* has an associated signal controller 50-*n*-*n*, e.g., the signal controller 50-1-1 is associated with the notification appliance 48-1-1**.

For the purposes of discussion, one or more NAC drivers 44-1 through **44-*n* will be henceforth be collectively referred to as "NAC drivers 44" and one or more associated NAC controllers 46-1 through 46-*n* will henceforth be collectively referred to as "NAC controllers 46". Further, one or more notification appliances 48-1-1 through 48-*n*-*n* will henceforth be collectively referred to as "Notification appliances 48" and one or more associated notification appliance controllers 50-1-1 through 50-*n*-*n* will henceforth be collectively referred to as "Notification appliance controllers 50**".

The arrangement described below allows notification appliances 48 to be synchronized even if they are not controlled by the same NAC driver **44-*n* (e.g. notification appliance 48-1-1, controlled by NAC driver 44-1, is synchronized with notification appliance 50-2-2, controlled by NAC driver 44-2**.)

The master controller 42 sends a synchronization signal to the NAC drivers 44 once every minute. During that interval, the NAC drivers 44 use their own internal clocks for reference. Each NAC driver 44 broadcasts its time position to its associated NAC every 4-second calibration period to ensure the synchronization of the notification appliances 48. Since the NAC drivers use crystals with good precision, their associated drift is significantly smaller than that of the untuned NACs.

Figure 2A:
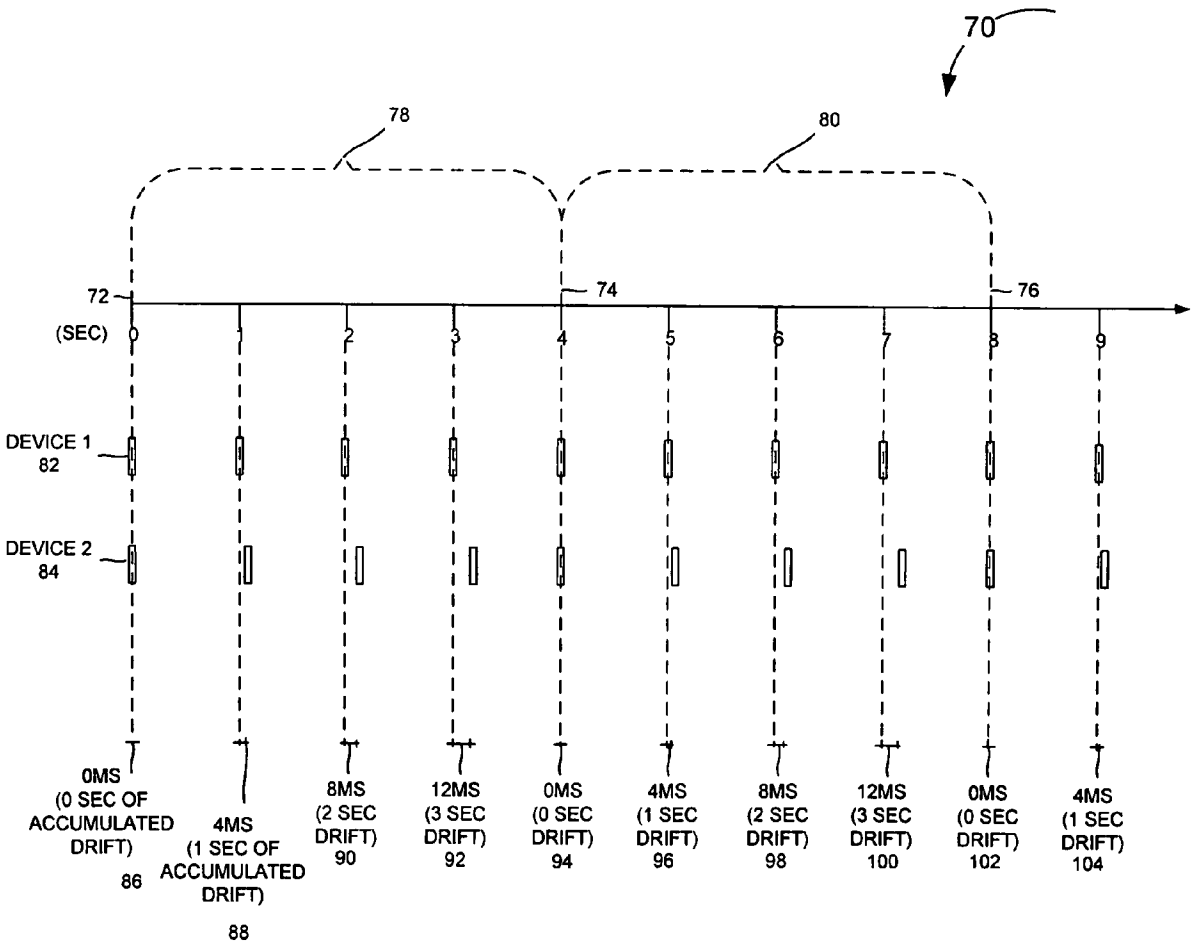
FIG. 2A is an exemplary illustration of a timing diagram corresponding to a temperature and/or aging induced clock source frequency drift.

FIG. 2A is an exemplary timing diagram 70 illustrating a temperature and/or aging induced clock source frequency drift that could occur within two exemplary notification appliances using prior art techniques. An advantage of this method is that it tightens the synchronization of the devices over multiple NAC drivers and compensates for steady state frequency variations, e.g., frequency shift induced by an increase in temperature when the device is activated.

In all operation modes, an NAC driver 44 broadcasts a synchronizing message including a calibrated time position at the start of each 4-second calibration time interval to each of its associated notification appliances 48. As illustrated in FIG. 2A, at time 0 (ref. 72) at the beginning of the calibration period 78, a first synchronizing message is sent by the NAC drivers 44 to notification appliances 1 and 2.

Note that while represented as the 0 second position, the synchronization signal's position could be expressed as 0+x ms. With the sync poll message being sent every 4 seconds, there could be broadcasts at 0+x ms, 4+x ms, 8+x ms and etc. Skilled artisans will appreciate that to facilitate comprehension and clarity, it was assumed that the synchronization message is sent at the zero position within the 4-second period. In reality, the broadcast of the synchronization poll could happen anywhere within the calibration frame.

Referring to FIG. 2A, times 72, 74, and 76 represent times at which a synchronization signal/message is broadcast from an NAC driver 44 to its associated notification appliances 48, here labeled device 1 and device 2. These times represent the start (or end) of calibration frames 78, 80.

Upon detection of an alarm condition by a detector 52 (FIG. 1), and the condition being forwarded to the notification appliances 48 via their respective controllers 44, the notifications appliances (devices 1 and 2) flash at their respective preset flashing intervals. Without the present invention, assuming that device 2's clock is running slow, the actual time at which each device flashes is indicated at 82 for device 1 and at 84 for device 2. In this example, device 1's clock operates at a desired frequency without any frequency drift. For example, device 1 may operate at a frequency of 8 MHz, while device 2's clock may operate at a frequency slower than the desired frequency, say 7.968 MHz, resulting in a frequency drift of 4 milliseconds (ms) per second. This drift may cause the clock source of device 2 to operate at about 0.4% slower than desired, resulting in unsynchronized flashing between device 1 and device 2.

Prior to further discussion of an example of drift, the notification appliance controller 50 is described in more detail. Each of the notification appliances has a clock that is supposed to operate at regularly occurring pulses used to measure the passage of time. In this example, the notification appliance has an operating frequency of 8 MHz. In addition to a clock, the notification appliance defines a "tick" period having an adjustable duration. For example, a tick period may be preset to 2 milliseconds (ms), in which case there are 500 ticks per second. However, if the clock frequency drifts, for example down to 7.968 MHz, then a tick would have a duration of approximately 2.008 ms and therefore 500 ticks would take approximately 1.004 second. As will be explained in further detail, according to an embodiment of the present invention, the notification appliance controller 50 compensates for this drift by adjusting the tick period in such a way that a fixed number of tick iterations, say 500, will yield a duration of close to one second.

Referring back to FIG. 2A, at time 86 (0 seconds into calibration frame 78) the relative frequency drift between device 1 and device 2 is 0 ms; similarly, four seconds later, at time 94 (0 seconds into calibration frame 80) the relative frequency drift between device 1 and device 2 during time period 80 is 0 ms, because the calibration time position (synchronization signal) has just been received. However with differences in the two devices' clock frequencies, at time 88 (1 second into calibration frame 78), the relative frequency drift between device 1 and device 2 is 4 ms. At time 90 (2 seconds into calibration frame 78), the relative frequency drift between device 1 and device 2 is 8 ms. Moreover, at time 92 (3 seconds into calibration frame 78) the clock source frequency drift between device 1 and device 2 is 12 ms. It can be seen from the timing diagram 70 that a typical clock operating 0.4% slower than the desired frequency can result in 12 ms of accumulated clock source frequency drift in 3 seconds. As explained before, skilled artisans will appreciate that this figure illustrates an example of the relative drift between devices 1 and 2, as a synchronization poll can be sent any time within the calibration frame. From FIG. 2A, skilled artisans will understand that the worst case drift condition will occur within the last second preceding the broadcast of a synchronization poll.

The synchronization at time 94 at the beginning 74 of calibration frame 80 does not allow the drift to continue to grow beyond 12 ms, however the corresponding frequency drift between device 1 and device 2 during sync frame 80 again begins to accumulate as seen at times 96, 98 and 100. It can be seen from FIG. 2A that the abovementioned frequency drift phenomenon occurs between each synchronization. Therefore the flashing of two such visible strobe notification appliances 48 represented by device 1 82 and device 2 84, visible from a common point will not be in conformance with the 10 millisecond synchronization requirement.

Figure 2B:
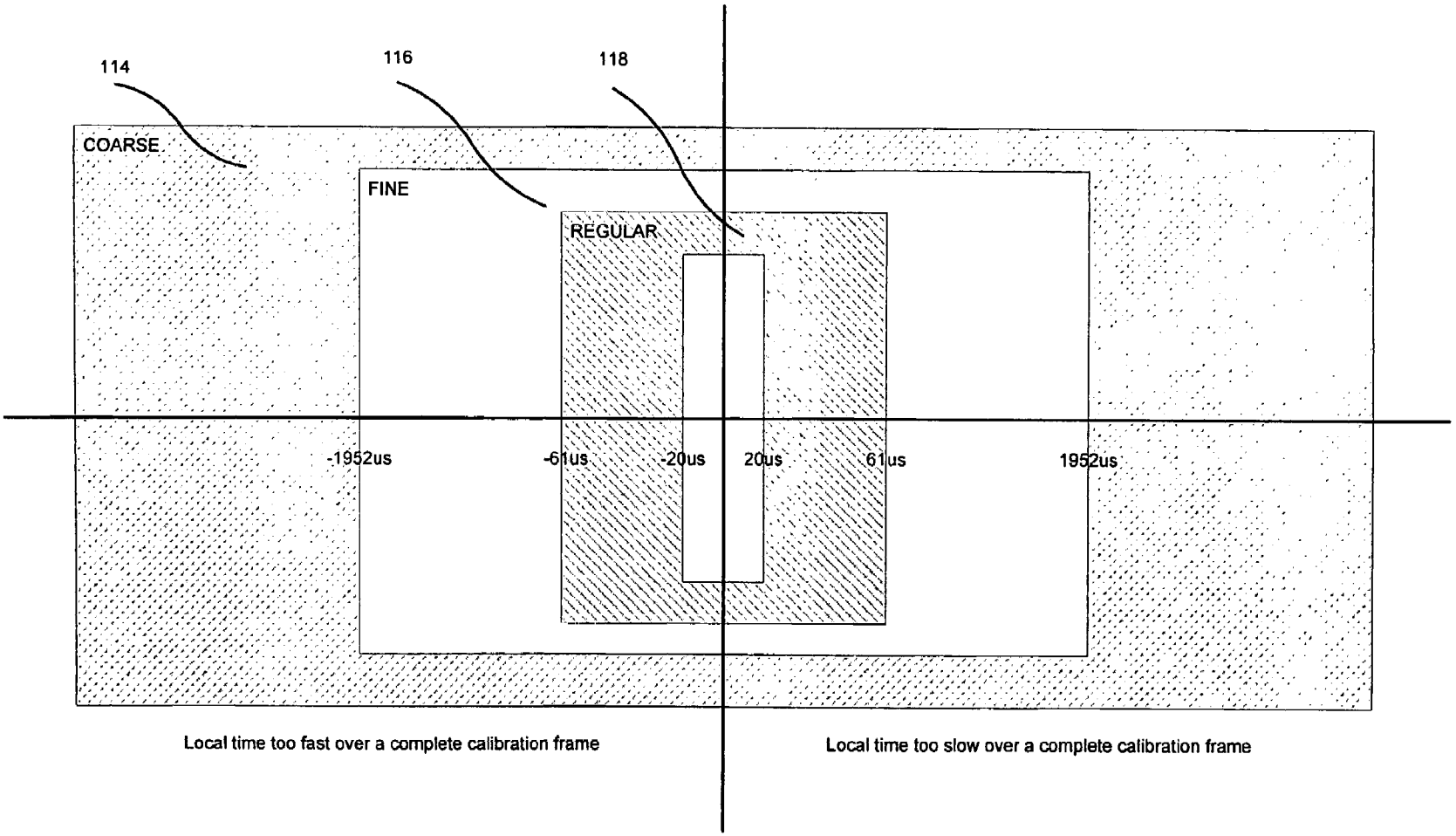
FIG. 2B is a graphical representation of the three tuning phases of the system.

FIG. 2B is a graphical representation of the three tuning phases of the system according to an embodiment of the present invention. Each notification appliance 48 (FIG. 1) defines its own tick period and maintains a tick counter. When a predetermined number of ticks have been counted, the strobe flashes (if turned on). The goal is to synchronize each notification appliance 48 (FIG. 1) with its associated NAC driver 44 by adjusting the tick period. While the graph shows two dimensions to amplify the targeting desire, the time shift has one dimension (the horizontal axis).

Figure 3:
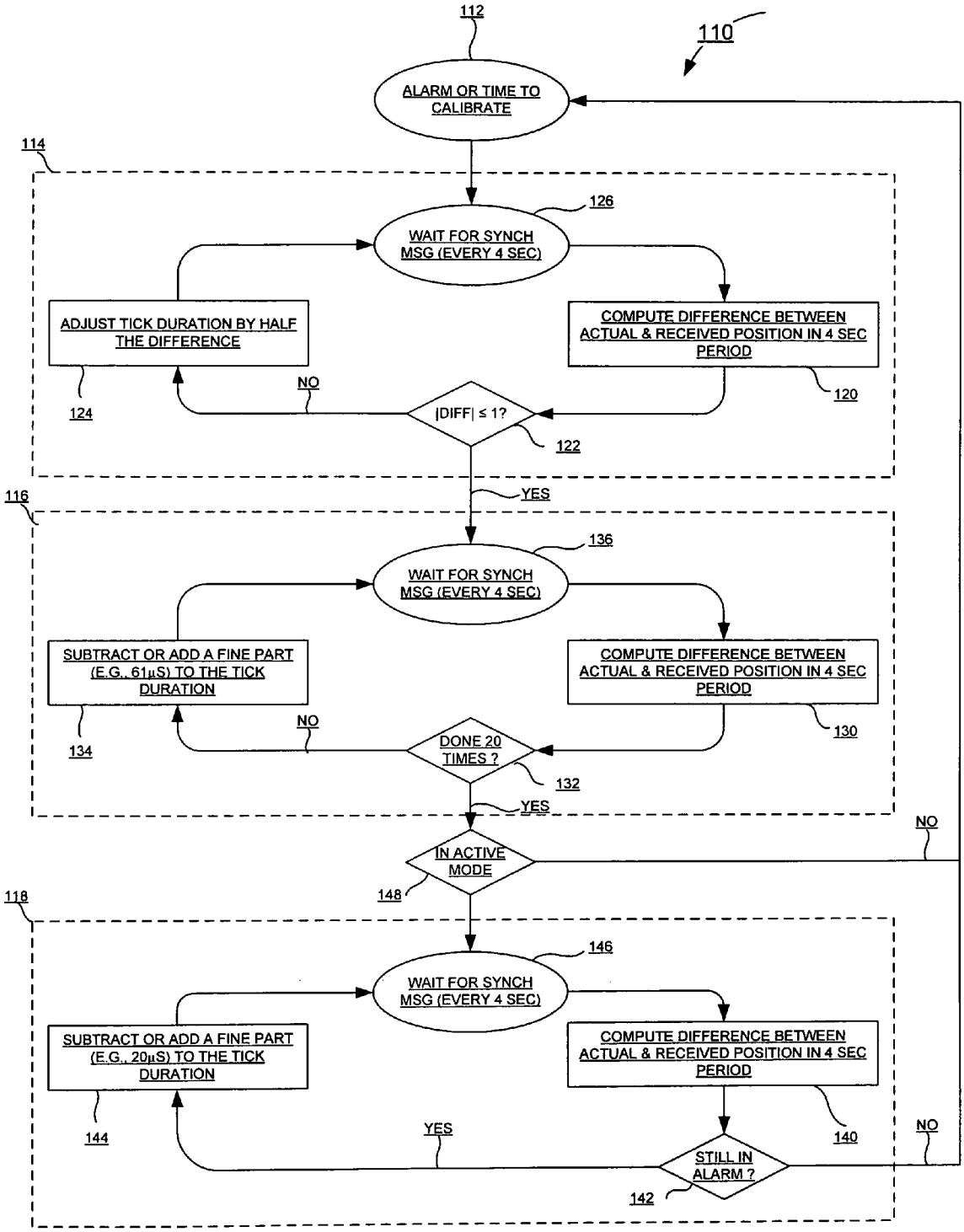
FIG. 3 is a flow diagram of a method for tuning clock source frequency drift of notification appliances, in accordance with an embodiment of the present subject matter.

As will be further explained with respect to FIG. 3, the inventive tuning algorithm has a coarse tuning phase 114, a fine tuning phase 116, and a regular tuning phase 118. Each phase, using the synchronization poll as a time reference, acts on the tick period of the notification appliance 48 to make the flashing interval constant, thus reducing the time difference between activation of the various notification appliances in a system.

FIG. 3 is a flow chart of a method 110 for tuning clock source frequency drift of a notification appliance according to at least one embodiment of the present invention. A NAC driver 44 (FIG. 1) receives an alarm condition and consequently commands each notification appliance 48 to flash substantially continuously at a preset flashing interval.

In step 112, a notification appliance receives a synchronization poll from its associated NAC driver periodically at a predetermined calibration time interval (e.g., approximately every four seconds which we will call a calibration frame). The synchronization signal includes a time stamp to indicate a current time position within an absolute 4-second calibration frame. A timestamp indicates a position (i.e., offset or delay) within the 4-second calibration interval, since sync polls can be sent anytime within a calibration interval. In these embodiments, the flashing interval is substantially less than the calibration time interval. For example, the flashing interval may be about 1 second while the calibration time interval may be approximately 4 seconds.

While being presented as performed during the activation of the notification appliances 48 for ease of comprehension, the present tuning algorithm can also be executed in standby mode in order to minimize the effects of the clock frequency shifts caused by the frequency tolerance, temperature and aging upon entering the active mode. In that particular case, during standby mode, preferably only the coarse and fine phases are executed.

In at least one embodiment, a tick period is defined as having a base value and a signed fractional adjustment value, the latter being a signed fraction of the total number of ticks per seconds. In practice, at the beginning of a 1-second strobe period, a counter is loaded with the base value plus or minus one, depending on the sign of the fractional adjustment value. This counter is automatically incremented at regular intervals, and when its content reaches the maximum possible value, the counter rolls over to zero; this event determines the end of a tick period and the start of the next tick period. When the number of counter rollovers is equal to the fractional adjustment value, the counter is reloaded only with the base value for the remainder of the iterations required to cover a complete second.

For example, if the fractional adjustment value is 50 and there are 500 tick iterations per second, the counter will be loaded for the first 50 iterations with the base value plus or minus one time quanta and will be loaded with the base value for the remaining 450 iterations. Obviously, other ways of implementing a fractional adjustment value would be easily determined by a person having ordinary skill in the art.

For comprehension and clarity purposes, we shall arbitrarily fix the number of ticks per second to be 488 (or 1952 ticks per calibration frame), the fractional adjustment value to be +88 and the tick period to be 2049 quanta. We shall also arbitrarily set a time quanta—or counter granularity—to be 1 us. These values are not static and other sets of values could be defined by a person having ordinary skill in the art. For the present example, in an embodiment using a perfect clock source of 8 MHz, the duration of a second would be $$(488-88)*\text{tick basevalue}+88*(\text{tick basevalue}+1)= (488-88)*2049\text{ us}+88*2050\text{ us}=1\text{ sec} \quad [LV1]$$

As can be seen from the previous equation, the fractional adjustment value is of positive sign, meaning that the fractional adjustment factor needs to be added to the tick period base value.

The system 40 has a coarse tuning phase 114, a fine tuning phase 116, and a regular tuning phase 118. In each phase, tick period is adjusted according to a different scheme. In the example as outlined in FIGS. 3-6, the coarse tuning phase adjusts the base value of the tick period by half of the error. Whereas in the fine tuning phase 116 and the regular tuning phase 118 in this example change is performed to the fractional adjustment value. For explanation purposes, these values have been arbitrarily set to 61 microseconds (μs) and 20 microseconds (μs) respectively, and are added or subtracted to the fractional adjustment value depending on the decisions made in the tuning phases 116 and 118 respectively. Of course, the absolute value of fractional adjustment part cannot exceed the number of ticks per seconds i.e. if, as mentioned above, the number of ticks is set to 488, then the fractional adjustment value cannot exceed 488. If this happens, the base value is modified by one and the fractional adjustment value is recomputed as a modulo of the number of ticks per seconds. Inversely, if the fractional adjustment value of a negative sign was to exceed the number of ticks per second following a subtraction, the base value of the tick period would be decreased by one and the fractional adjustment value would be recomputed also as a modulo of the number of ticks per seconds.

At step 114, a coarse tuning phase is performed. Each notification appliance 48 adjusts itself independently of any other notification appliance; if each notification appliance is adjusted so there is no lag or lead in relation to the master controller 42, by definition all the notification appliances 48 will be synchronized with each other.

Still referring to FIG. 3, during the coarse tuning phase 114, a coarse adjustment to the flashing interval is performed if the computed time difference between the local time and the received calibration time exceeds a deviation time threshold, e.g., one tick period. Further, the notification appliance remains in the coarse phase until the difference between the local time and the received calibration time is less than or equal to the deviation time threshold. A person having ordinary skill in the art will understand that in some embodiments, due to integer computation, fractional part of any division is rounded down to the nearest integer. This means that a numerator value contained in the interval $$1 \leqq \text{numerator} < 2$$

will always yield a value of 1 when divided by two i.e.

$$\frac{\text{numerator}}{2} \equiv 1$$

In step 120, the difference between the local time and the received calibration time is computed for each notification appliance at substantially the end of each calibration time interval. The term "local time" here refers to the time maintained at the notification appliance 48 level, and that is used to pace the strobe activation. The term "received calibration time" is the transposition in tick count of the timestamp value contained in the synchronization poll. In other word, when a synchronization poll is received, the timestamp value contained therein is converted to an absolute tick count over the duration of a calibration frame and the difference is computed between this value and the local tick iterations count.

For example, using values arbitrarily set in a previous paragraph, let's assume that one embodiment of the present matter has synchronization poll sent at precisely the third second's edge of each calibration frame. The converted timestamp value at that precise moment would yield a value of 1464 i.e. 3*488 ticks per seconds. If we suppose that the local tick iteration count at that precise moment is 1454, then the computed deviation will give a difference of 10 tick counts. This difference in tick counts is calculated in step 120. If the calculated deviation time is greater than 1, then the base value of the tick period of the notification appliance is adjusted relative to the clock pulse to half the difference of the calculated tick deviation count in step 124. In the current examples, the base value of the tick period was set to have a value that is comparable to the value of the number of ticks over a calibration frame. This is intentional, so that a modification of one to the base value of the tick period is almost similar to a reduction or increase of one tick over a calibration frame.

In step 126, the notification appliance 48 (FIG. 1) waits for the next synchronization signal. As seen from FIG. 1, the notification appliance 48 receives a synchronization signal from the NAC driver 44-*n* periodically at a predetermined calibration time interval (e.g., every four seconds) in step 128. Steps 120-126 are subsequently repeated as appropriate. Once the measured or calculated deviation time satisfies the deviation time threshold in step 122, then the algorithm moves on to the fine tuning phase 116.

During the fine tuning phase 116, a fine adjustment to the preset flashing interval at each calibration time interval is performed for a predefined number, e.g., twenty, of calibration frames to compensate for the worst case residual drift left out by the coarse tuning phase. The number of fine tuning iterations is dependant on the fractional adjustment value, and must be selected in order to cover a larger range than the worst case residual error left during the coarse tuning phase. It can be shown that this error can reach a value of up to 2 time quanta multiplied by the number of tick iterations over a calibration frame. This is due to the fact that once the signal controller exits the fine tuning phase, the difference between the local time and the received calibration time must oscillate between zero and one. This means that, if upon entering the fine tuning phase, the difference is of minus one tick count, then 2 complete tick count difference must be compensated by this phase. Thus, the number of fine tuning iterations must be so that $$\text{Fine tuning iterations}*(N_{fine\ tuning\ increments/sec}*4\ \text{sec}) > 2_{time\ quantas}*(4\ \text{sec}*N_{ticks\ per\ sec})$$

i.e. if we use the set of arbitrary values described earlier $$\text{Fine tuning iterations} > \frac{(2*1\ \text{us})*(4*488_{ticks/sec})}{4*61\ \text{us}}$$

or, in that special embodiment $$\text{Fine tuning iterations} > 16$$

During the fine tuning phase 116, the difference between the local time and the received calibration time is computed (step 130) substantially at the end of each calibration frame. At step 132, it is determined whether all of the fine tuning iterations have been performed on the preset flashing interval for the predefined number of times. If not, then at step 134, a fine time duration (for example 61 μsecs) is added to or subtracted from the tick fractional adjustment value depending if the tick iterations difference yields a positive or negative/null result. Each notification appliance then waits until the synchronization signal is received from the initiating device as step 136. Upon receiving the synchronization signal from the initiating device, steps 130-136 are repeated. At the end of this phase, the difference between the local time and the received calibration time should lead by approximately one tick period (if no processing delay inside the notification appliance is accounted for) over the entire calibration frame. This is because the time difference is computed using ticks as the smallest measurable unit. At the device level, this is not a problem, as the main objective is to guarantee that all notification appliances activate their flash approximately at the same time, relative to each other. A person having ordinary skills in the art will understand that the selection of the number of ticks per second and the base value of the tick period will directly influence the magnitude of the error over a complete calibration frame.

Alternatively, if the maximum number of fine tunings allowed have been performed, as determined at step 132, and if the system is in active mode, then the algorithm proceeds to the regular tuning phase 118. In the regular tuning phase 118, a regular/normal adjustment is performed on the preset flashing interval at each calibration frame until the alarm condition is no longer detected by the NAC driver 44. At step 140, the difference between the local time position and received calibrated time position is computed.

If the alarm condition still exists as determined at step 142, a regular tuning is performed on the preset flashing interval. At step 144, a fine duration, e.g., 20 μsecs, is added to or subtracted from the tick fractional adjustment value depending if the tick iterations difference yields a positive or negative/null result. The notification appliance waits during step 146 for the synchronization signal, after which steps 140-146 are repeated as discussed above. As this phase is entered following the completion of the fine tuning phase, the difference between the local time and the received calibration time shall mostly oscillate around one in steady alarm state, unless perturbations caused by the effect of temperature or aging arise.

For example, if the clock of a specific notification appliance 48 is accurate or "right on," that is, exactly 8 MHz in the example, the tuning algorithm will pass through the coarse tuning phase 114 without doing anything. The tuning algorithm will then proceed to the fine tuning phase 116 where it would either add or subtract e.g. 61 microseconds (μs) to the fractional adjustment value every four seconds through e.g. 20 calibration frames or 80 seconds. Then the calibration process enters the regular tuning phase 118 where it either adds or subtracts e.g. 20 microseconds (μs) to the fractional adjustment value every four seconds until the alarm is silenced. As explained before, while in steady state mode in phase 118, the maximum deviation should lead the second by approximately on quarter of a tick period, i.e. a complete tick period over the entire calibration frame.

In the alternative, if the clock frequency of a specific notification appliance 48 has drifted to 7.944 MHz, then in each phase the tick period will be adjusted so that the deviation of the strobe flash with regards to the absolute second is within the allowable range. The timing diagram will be shown to further describe each phase.

Figure 4:
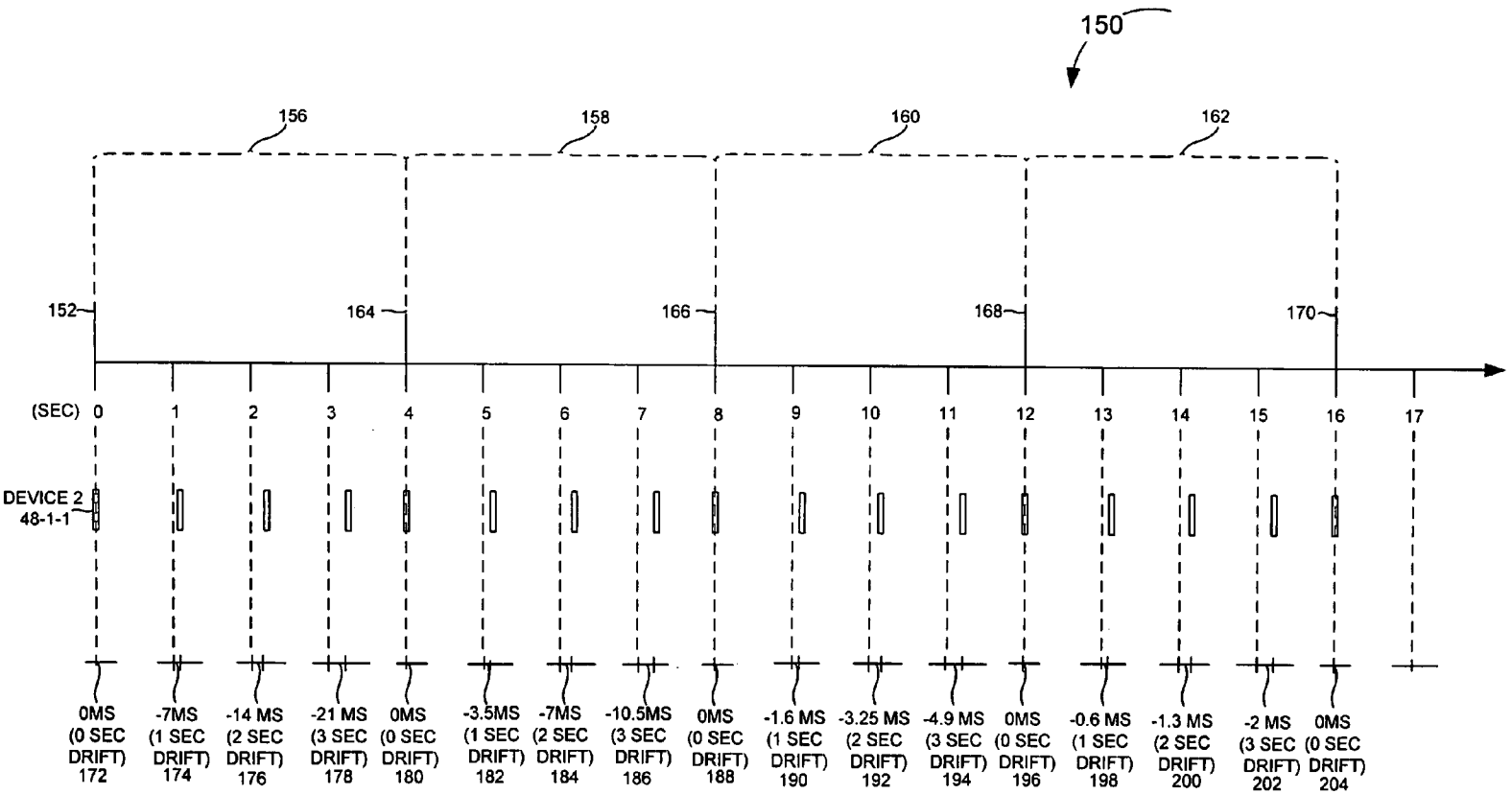
FIG. 4 is an exemplary illustration of a timing diagram of a coarse tuning operation corresponding to a method for tuning clock source frequency drift of notification appliances.

FIG. 4 is an exemplary timing diagram 150 illustrating the operation of a coarse tuning phase 114 of FIG. 3. Once an alarm condition has been detected, the NAC driver 44 sends out an activation command to one or more notification appliances 48 and continues to broadcast the synchronization poll once every calibration frame. For simplicity, only one notification appliance 48-1-1 is illustrated in the timing diagram 150. Four 4-second calibration frames 156, 158, 160, and 162 are shown.

As explained in further detail below and outlined above with respect to FIG. 3, tuning continues until the alarm is deactivated by one of the various methods including a person, such as a fighter, resetting the system 40. For the majority of the time, when in alarm, the system 40 will be in the regular tuning phase 118 since the coarse 114 and fine 116 tuning phases are only executed at the beginning of the calibration sequence. Preferably, calibration is performed upon startup of the system and at variable time intervals to minimize the strobe activation drift upon transition from standby to active mode.

At the start 152, 164, 166, and 168 of each of the respective calibration frames 156, 158, 160, 162 the NAC driver 44, as seen in FIG. 1, broadcasts a synchronization signal to devices on the its associated NAC. The actual time at which the device 48-1-1 flashes is indicated by the box.

As shown in the timing diagram 150, device 48-1-1 starts to flash substantially continuously at the beginning of the time period 156. In this example, the notification appliance 48-1-1 clock has a frequency drift of 7 ms/second, operating at a frequency 7.944 MHZ, about 0.7% slower than the desired operating frequency. Note that this is different from the 4 millisecond drift per second shown in FIG. 2. Under this operating frequency, an ideal time quanta of e.g. 1 us would thus be increased by 0.7%, resulting in a time quanta of 1.007 us. The embodiment shown in FIGS. 4-6 was chosen to show that the system could handle a worse case of drift.

Obviously, different notification appliance controllers 50 can have different frequency drifts during the same calibration frame (e.g., controller 50-1-1 has a 7 ms/second drift and the controller 50-2-2 has a 4 ms/second drift). Moreover, the drift can be in opposite directions.

At time 172 (0 seconds into calibration frame 156) the relative drift is 0 ms; at time 174 (1 second into calibration frame 156), the drift is 7 ms; similarly, by time 176 (2 seconds into calibration frame 156), the clock has drifted by 14 ms; at 3 seconds 178 the cumulative clock drift is 21 ms. It can be seen from FIG. 4 that a frequency drift of 0.7% can cause the clock drift to increase in steps of 7 ms for every second. At the end of the calibration frame 156, the notification appliance 48-1-1 receives a synchronization signal from the NAC driver 44-1. While the triggering of the flash of the visible alarm (strobe) can be timed so that it is coincident with the synchronization signal, the flash trigger is independent of the synchronization message. The synchronization message could be sent in between two flashes. However for this example, we will link the events.

If the notification appliance 48-1-1 had flashed at the $4^{th}$ second according to its own clock, the flash would have occurred 28 ms later. In other words, the effect of the drift is at its minimum at the first flash after the synchronization message is received.

The signal controller 50-1-1 of the notification appliance 48-1-1 determines the difference between the local time and the calibrated time position received from the synchronization message. In this example, based on previous arbitrary values, the signal controller 50-1-1, determines that only 1938 ticks counts (current local device position in the 4 sec period) have occurred, rather than 1952 ticks counts (current system position in the 4 second period, using 488 ticks per second). In block 120 as seen in FIG. 3, it is determined that there is a difference of −14 ticks.

Referring back to FIG. 3, step 122, the absolute value of the difference (−14 ticks) between the local time and the received calibration time is greater than 1 tick, so the signal controller 50-1-1 adjusts the base value of the tick period. In this case the base value of the tick period, i.e., the number of clock pulses in a tick, is decreased.

As indicated in block 124 of FIG. 3, the base value of the tick period is modified by half the computed error i.e.

$$(1938-1952)_{ticks} = -14_{ticks} \Rightarrow \frac{-14_{time\ quanta}}{2} = -7_{time\ quanta}$$

Ideally, the base value of the tick period should be 2049 time quanta if the clock operates at 8 MHz. In that the clock is operating more slowly, the base value of the tick period must be reduced by 7 time quanta to 2042. Referring back to FIG. 4, while the duration of the tick has been adjusted, the time difference, the drift, of 28 ms which occurred during the time period 156 is reduced not to zero but would be of approximately 14 ms if the notification appliance 48-1-1 had waited for the local signal at the $8^{th}$ second i.e.

$$-28_{ms/calib\ frame} - (-7_{quanta/tick} * 1952_{ticks/calib\ frames} * 1.007_{us/quanta}) \approx -14_{ms/calib\ frame}$$

At time 182 (1 second into calibration frame 158) a clock source frequency drift of 3.5 ms results; at time 184 (2 seconds into calibration frame 158) the cumulative drift is 7 ms; at time 186 (3 seconds into calibration frame 158) the cumulative drift is 10.5 ms. At the end of the calibration frame 158, the notification appliance 48-1-1 receives a synchronization signal from the NAC driver 44-1 and flashes the visible alarm (strobe). If the notification appliance 48-1-1 had waited for the synchronization poll at the $8^{th}$ second, the flash would have occurred 14 ms later. As indicated above, the flash and the synchronization are linked for this example. In other embodiments, synchronization polls could be generated anywhere within the 4 seconds calibration frame without modifying the effect of the drift presented in FIG. 4, i.e., that the drift pattern will be consistent whatever the position of the sync poll within the calibration frame. The purpose of the tuning algorithm 110 is to adjust the local time position to the system time position knowing e.g. that the synchronization message could be sent in the middle of two flashes.

The difference between the local time and the system time position received inside the synchronization message is again determined (step 120) at time 166. Assuming again 488 ticks per seconds, at time 166 the signal controller determines that only 1944 ticks have occurred instead of the expected 1952 ticks, in block 120 as seen in FIG. 3, it is computed that there is a difference of −8 ticks.

Referring back to FIG. 3, it is determined in step 122 that the absolute value of the difference between the local time and the received calibration time is greater than one tick period, and so again the tick duration is adjusted, in this case, decreased.

Since only 1944 ticks have occurred when the next synchronization signal is received, the system is slow by 8 ticks. Once again the base value of the tick period is fixed by half of the error.

$$(1944-1952)_{ticks} = -8_{ticks} \Rightarrow \frac{-8_{time\ quanta}}{2} = -4_{time\ quanta}$$

The tick period after the last cycle was set to 2042 time quanta. The signal controller now must reduce the base value of the tick period by 4 time quanta, thus yielding 2038 time quanta.

Referring back to FIG. 5, while the duration of the tick has been adjusted, the time difference, drift, of approximately 14 ms which occurred during the time period 158 is reduced not to zero but would be of approximately 6.5 ms if the notification appliance 48-1-1 had not received the synchronization poll at time 196, as given by $$-28_{ms/calib\ frame}-(-(7+4)_{quanta/tick}*1952_{ticks/calib\ frames}*1.007_{us/quanta})\approx-6.5_{ms/calib\ frame}$$

At time 190 (1 second into the third calibration frame 160) a clock source frequency drift of approximately 1.6 ms results; at time 192 (2 seconds into calibration frame 160) the cumulative drift is approximately 3.25 ms; at time 194 (3 seconds into calibration frame 160) the cumulative drift is approximately 4.9 ms. At the end 168 of the calibration frame 160, the notification appliance 48-1-1 receives a synchronization signal from the NAC driver 44-1 and flashes the visible alarm (strobe). If the notification appliance 48-1-1 had waited for the local signal at the 12th second, the flash would have occurred 6.5 ms later.

The process is continued until the difference between the local and the synchronization signal is equal or less than 1 tick as determined in block 122. In the example, the switch from coarse to fine tuning phase would have occurred after 20 seconds, because the tick count difference would have been less than one. Assuming no sync poll was received after 20 seconds, and since the base value of the tick period would have been reduced by 14 time quanta (7 at time 164, 4 at time 166, 2 at time 168 then 1 at time 170), the residual drift left by the coarse tuning phase would be $$-28_{ms/calib\ frame}-(-(14)_{quanta/tick}*1952_{ticks/calib\ frames}*1.007_{us/quanta})\approx-0.68_{ms/calib\ frame}$$

i.e. roughly 680 us. Thus by the $20^{th}$ second, according to block 122, we move into the fine tuning phase 116.

While the example of the coarse phase tuning 114 shows the drift lagging, it is recognized that the drift could also lead. If the drift is leading, the number of pulses per tick would be increased to adjust.

Figure 5:
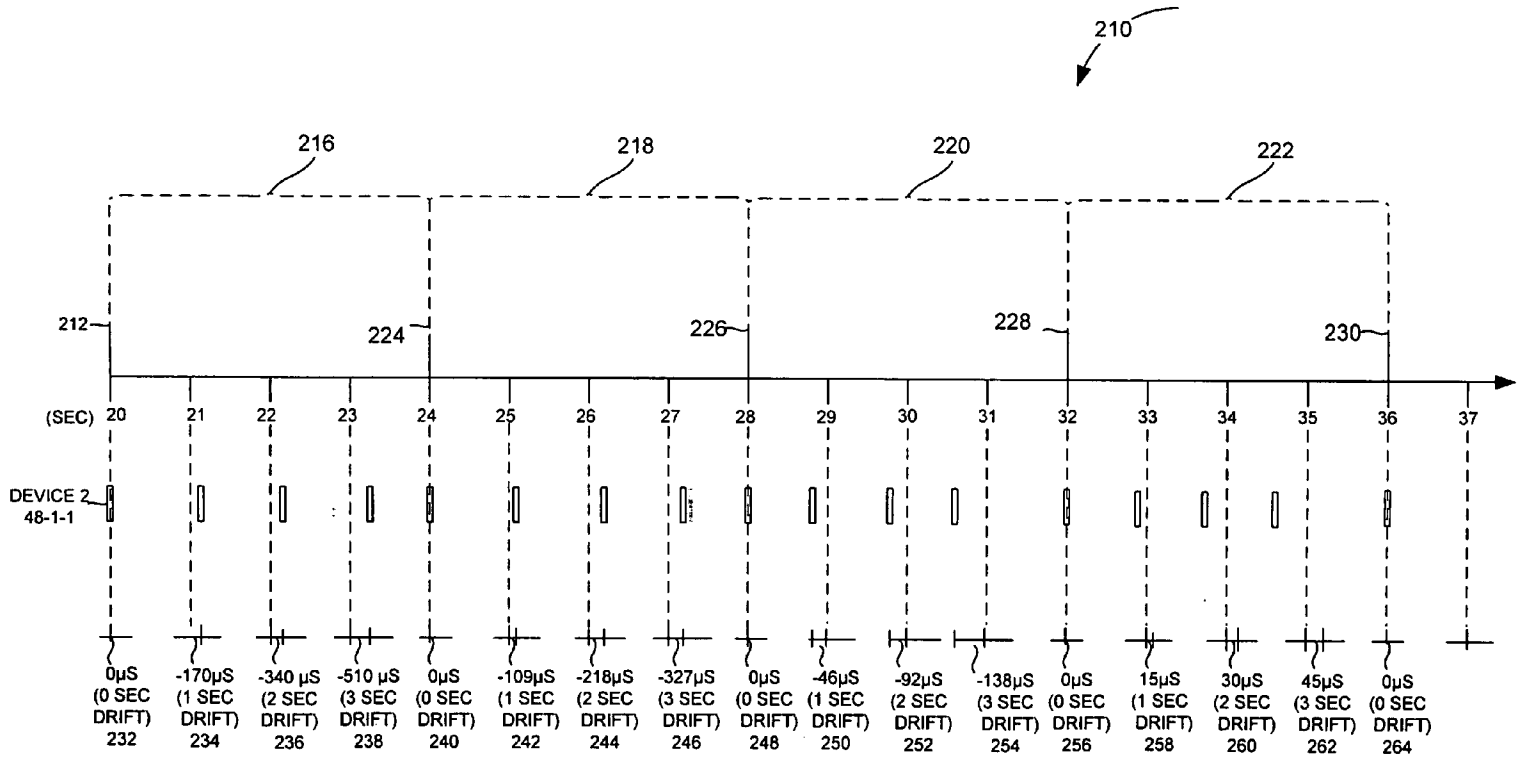
FIG. 5 is an exemplary illustration of a timing diagram of a fine tuning operation of a method for tuning clock source frequency drift of notification appliances.

FIG. 5 is an exemplary timing diagram 210 illustrating operation of a fine tuning phase for tuning clock source frequency drift of each notification appliance. The timing diagram 210 shows an exemplary implementation of the fine tuning operation that is performed during each 4-second calibration frame.

Moreover, FIG. 5 illustrates the performing of the fine tuning operation on device 48-1-1 four times in a sixteen (16) second time period. Referring back to FIG. 2, the fine tuning phase 116 does not occur until the criteria in step 122 of the course tuning phase 114 has been met (i.e., the difference between local time and the calibration time is less than one tick). In that it took 20 seconds in our example, the time period shown in FIG. 5 is between 20 and 36 seconds. The predetermined time interval corresponding to 4 seconds is represented by calibration frames 216, 218, 220 and 222.

In that the drift in this example is lagging by 680 μsecs per calibration frame after the coarse tuning phase 114, which is where the fine tuning phase 116 starts in this example. 20 seconds into calibration, at time 232 (the start of calibration frame 216) there is a drift of 0 μs (microsecond). At time 234 (1 second into calibration frame 216) there is a drift of 170 μs. Similarly, at time 236 (2 seconds into calibration frame 216) there is a drift of 340 μs; and at time 238 (3 seconds into calibration frame 216) there is a drift of 510 μs. The drift is based on both the clock source frequency and the adjustments made during the coarse tuning phase 114. In step 130 (FIG. 3), the notification appliance 50-1-1 calculates the difference between its current position and the system position. The system time position is included in the synchronization message. In this example, at the end of calibration frame 216, at the 4th second, a time difference of 680 μs between the local time position and the broadcast time position for device 2 48-1-1 would have occurred if the synchronization signal had not been received.

After the coarse tuning phase 114. the signal controller **50-*n*-*n* does not know the actual speed of its clock so the system tuning algorithm 110 merely determines if the tick count is lagging or leading and then adds or subtracts respectively the fine tuning phase value e.g. 61 μsecs to the fractional adjustment part of the tick period. As explained before, after each iteration of the fine tuning algorithm, we will increase or reduce the duration of a calibration frame by four times the fine tuning fixed value multiplied by the time quanta e.g. in an embodiment having a perfect 8 MHz clock and a fixed value of 61 as the fine tuning fixed value, we shall increase or reduce the duration of a calibration frame by 244 us. This means that, at the end of frame 224, 61 quanta need to be subtracted from the original arbitrarily fractional adjustment value e.g. 88, thus leaving 27. In the present example, the first iteration of the fine tuning phase will yield a residual error of 430 us at end of frame 226** as given by $$-680_{us/calib\ frame}-(-(244)_{quanta/calib\ frame}*1.007_{us/quanta})\approx-0.430_{us/calib\ frame}$$

Following the steps of the fine tuning phase 116, the fractional adjustment value of the tick period will again be adjusted by removing another 61 from the previous value e.g. 27 at end of frame 226. Since the result of this subtraction is negative, we remove 1 from the base value of the tick period and add 488 to the fractional part before removing 61. In other term, if the base value of the tick period was 2035, we would get $$(27-61)_{fav/tick}\Rightarrow(2035-1)_{quanta/tick}+((488+27)-61)_{fav/tick}\Rightarrow0.2034_{quanta/tick}+454_{fav/tick}$$

The same pattern would repeat at end of frame 228 and once again, 244 time quanta are removed, yielding a fractional adjustment value of 393. Reusing the previously computed value, there is a residual lagging drift of approximately 185 us at that instant. This continues for the remaining iterations of the fine tuning phase, until the difference between the local time and the received calibration time oscillates between zero and one.

For simplicity, only the first four fine adjustments to device 2's tick duration are illustrated by the timing diagram 210. Referring back to FIG. 5, the position in time 232 represents a clock source frequency drift of 0 μs at 20 seconds corresponding to a 0 second frequency drift during time period 216 as synchronization poll was received and drift reduced to zero. Assuming the sync poll was not received, the drift would be equal to the residual error left by the coarse tuning phase e.g. in the present case 680 us per calibration frame or 170 us per second. Once a first calibration frame is received, the fine tuning adjustment value is added or subtracted from the fractional adjustment value; referring back to FIG. 5, this happens at end of frame 224. Contrary to the coarse tuning phase, the fine tuning phase acts directly on the flash drift every second because it uses a fixed adjustment value instead of half of the tick count difference. Only the sign of this adjustment is determined upon reception of the synchronization poll. Thus at time 242 (1 second into calibration frame 218) there is a clock drift of approximately 109 μs, i.e., 170 us minus 61 us; and at time 244 (2 seconds into calibration frame 218) there is a clock drift of approximately 218 μs. Similarly, at time 246 (3 seconds into calibration frame 218) there is a clock drift of 327 μs. Assuming no sync poll was received at the end of calibration frame 218, the residual drift would thus be of approximately 430 μs; since this is not the case, the error is brought back to zero as shown at end of frame 226. At that precise moment, the difference between the local time and the received calibration time is computed and the sign of the fixed fine tuning value determined. If this difference is inferior to one, the fixed value is subtracted, else it is added.

In some embodiments, the fine tuning phase 116 operation is repeated until the fine adjustment of the clock tick duration corresponding to device 2 48-1-1 is performed a total of 20 times including the fine tuning phase 116 operations that will be performed during subsequent time periods following time period 222. In these embodiments, the regular or normal tuning phase 118 operation begins on device 2, when the fine adjustment to the clock tick duration of device 2 through the fine tuning operation is completed 20 times. Each notification appliance 48 is concurrently, in parallel, calibrating with the master clock; Depending on the drift amounts in each notification appliance, one notification appliance could be in the coarse tuning phase while another is already in the fine tuning phase. Using the previous arbitrarily values, it can be shown that upon completion of the 20 iterations of the fine tuning phase, the base value of the tick period will be equal to 2033 time quanta and the fractional adjustment value will oscillate between 393 and 332. Similarly, the flash activation drift will lead the second and vary between 505 us and 560 us per second when compared to the absolute second' edges of each calibration frame. As mentioned before, this is not critical, since the goal is to insure that notification appliances flash their strobe within a similar time window relative to each other.

Figure 6:
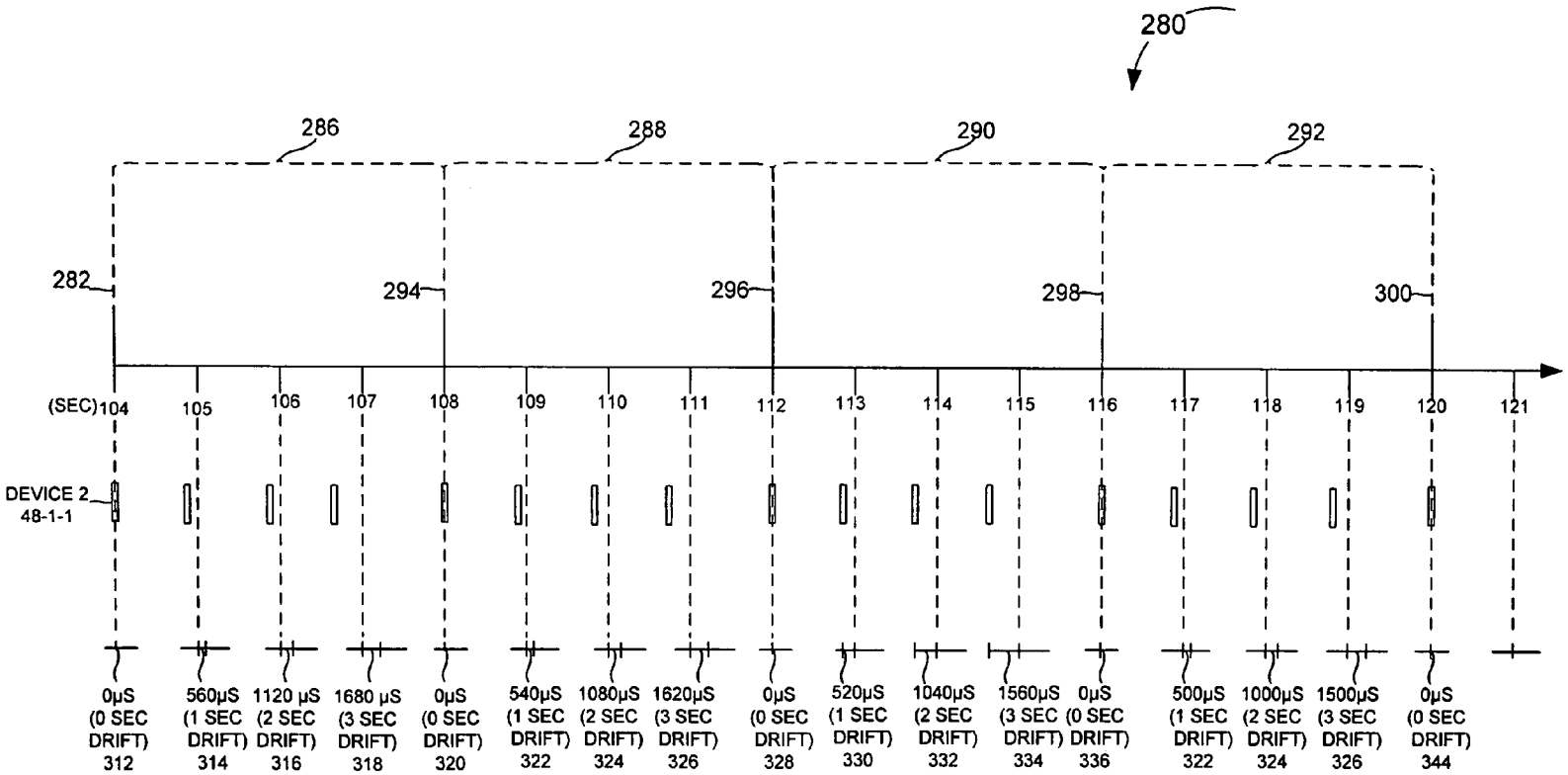
FIG. 6 is an exemplary illustration of a timing diagram of a regular tuning operation corresponding to a method for tuning clock source frequency drift of notification appliances.

FIG. 6 is an exemplary timing diagram 280 illustrating the regular tuning phase 118. The timing diagram 280 shows an exemplary implementation of the regular tuning operation performed every 4-second calibration frame period 286, 288, 290, 292. Referring back to FIG. 3, the regular tuning phase 118 preferably occurs after twenty (20) cycles of the fine tuning phase 116.

This example presumes that the coarse tuning phase 114 has taken 20 seconds and the fine tuning phase 116 has taken 84 seconds i.e. one calibration frame to comply with step 136 of FIG. 3, plus 20 calibration frames in phase 116. Thus, calibration frame 286 ranges from 104 seconds to 108 seconds and a synchronization signal is received (ref. 282) at 104 seconds by device 2 48-1-1.

If the alarm condition is still detected, a regular/normal adjustment is performed by adding or subtracting a regular tuning phase value, 20 in this example, to or from the fractional adjustment value. For simplicity, only the first four regular adjustments are illustrated in the timing diagram 280. It can be seen that device 2 may subtract 20 μs/second for a total of 80 μs per calibration frame. The regular or normal tuning phase is added to compensate for steady state perturbation to the clock frequency caused by aging or temperature. Its value should be fixed so that it is able to compensate for long term effects of these perturbations. Referring back to FIG. 6, and assuming the last fractional adjustment value after 20 fine tuning iterations is 332 at time 282 in frame 286 and that the difference between the local time and the received calibration time is one, then the regular tuning phase will thus add 20 to the fractional adjustment value once a first calibration frame is received as per step 146 in FIG. 3. This condition is reached at end of frame 294, and will bring the fractional adjustment value to 352, resulting in an increase of 80 time quanta or in this case 80 us at end of frame 296. At that moment, the tick count difference will still be 1, so once again, 20 will be added to the fractional adjustment value yielding a value of 372. At end of frame 298, the difference being still equal to one, 20 will be added once more to the fractional adjustment value. This will go on until the difference between the local time and the received calibration time is brought back to zero at end of frame 300. When this happens, 20 will be subtracted from the previous computed value, bringing the fractional adjustment value back to 372. From that moment, if the clock frequency was to stay stable, the fractional adjustment value would oscillate between those 2 values until alarm condition is removed. Any modification to the clock frequency will be followed by the regular tuning phase, as long as the worst case frequency variation over time is smaller than this phase's adjustment value.

The above-described method for tuning clock source frequency drift of one or more notification appliances provides an improved technique to compensate for frequency tolerance, frequency stability over temperature, and frequency stability over aging induced frequency drift. Further, the method for tuning clock source frequency drift including the coarse tuning, the fine tuning, and the regular tuning operations can provide synchronization between one or more notification appliances well within the UL 1971 requirement. Moreover, the above-described method may allow each notification appliance to correct for hardware imprecision to ensure meeting the UL 1971 requirement.

Figure 7:
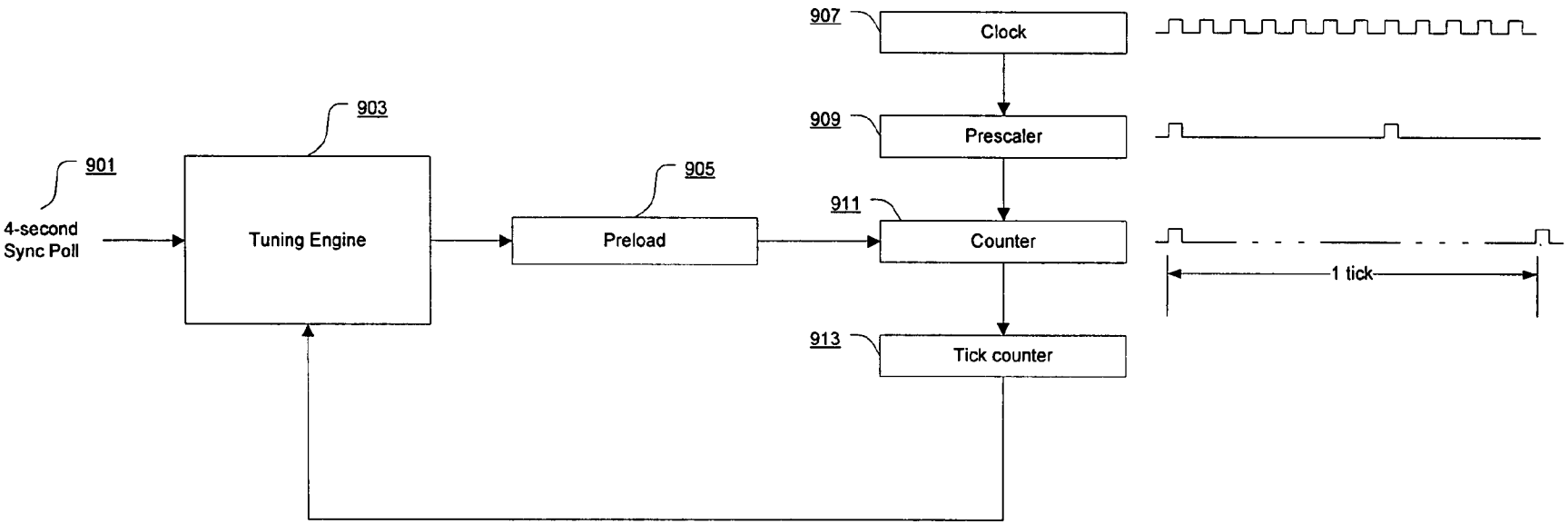
FIG. 7 is a block diagram illustrating conceptually an embodiment of the invention.

FIG. 7 is a block diagram illustrating conceptually an embodiment of the invention. A hardware clock 907 which is subject to frequency drift as described above, produces a nominal 8 MHz clock pulse. Prescaler 909 prescales the clock to provide a lower frequency pulse train. A counter 911 is preloaded with some value 905 set by a tuning engine 903 which executes the tuning algorithm discussed above. Each time the counter 911 rolls over defines the beginning of a new "tick", thus the preload value 905 defines tick duration. Another counter 913 counts the number of ticks, so that when a Sync Poll 901 (synchronization message) is received, the tuning engine 903 can compare the calibrated time received in the synchronization message and the local time as represented by the tick count in counter 913. To adjust the flashing interval, the tuning engine 903 adjusts the preload value 905. The tuning engine may be implemented in software or hardware, or a combination thereof.

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. A method for compensating for clock frequency drift in a notification appliance in an emergency evacuation and fire safety system, wherein the notification appliance is coupled to a controlling device, the method comprising:

initiating the notification appliance to flash substantially continuously at a preset flashing interval upon detecting an alarm condition, the preset flashing interval being based on a clock-based counter;

broadcasting a synchronization signal including a calibrated time periodically at a calibration interval to the notification appliance, wherein the preset flashing interval is substantially less than the calibration time interval;

computing a time difference between a local time maintained at the notification appliance and the calibrated time; and tuning the notification appliance by adjusting the clock-based counter and therefore the preset flashing interval based on the computed time difference of the notification appliance.

2. The method of claim 1, further comprising:

detecting the alarm condition by a device in communication with the controlling device.

3. The method of claim 1, wherein the preset flashing interval is approximately 1 second and the calibration interval is approximately 4 seconds.

4. The method of claim 1 wherein the notification appliance is one of a plurality of notification appliances and the controlling device is one of a plurality of notification appliance circuit (NAC) drivers connected to a master controller, each NAC driver associated with at least one notification appliance.

5. The method of claim 1, wherein tuning of the notification appliance comprises:

performing, during a coarse adjustment phase, a coarse adjustment to the preset flashing interval during each calibration frame, if the computed time difference exceeds a deviation time threshold;

performing, during a fine adjustment phase, a fine adjustment to the preset flashing interval during each of a predefined number of calibration frames; and performing, during a regular adjustment phase, a regular adjustment to the preset flashing interval during each calibration frame until the alarm condition is no longer detected.

6. The method of claim 1, wherein the one or more notification appliances are selected from the group consisting of visual only device, an audible/visual device, and a speaker/visual device.

7. A method for compensating for clock frequency drift in a notification appliance in an emergency evacuation and fire safety system, wherein the notification appliance is coupled to a controlling device, the method comprising:

initiating the notification appliance to flash substantially continuously at a preset flashing interval upon detecting an alarm condition, the preset flashing interval being based on a clock-based counter;

receiving, from the controlling device and periodically at a calibration time interval, a calibrated time, wherein the preset flashing interval is substantially less than the calibration time interval;

computing, at the notification appliance, a time difference between a local time maintained at the notification appliance and the received calibrated time; and adjusting the preset flashing interval by adjusting the clock-based counter, responsive to the computed time difference.

8. The method of claim 7, wherein the preset flashing interval is approximately 1 second and the calibration time interval is approximately 4 seconds.

9. The method of claim 7, wherein adjusting the flashing interval comprises:

performing, during a coarse adjustment phase, a coarse adjustment to the flashing interval during each calibration frame, if the computed time difference exceeds a deviation time threshold;

performing, during a fine adjustment phase, a fine adjustment to the flashing interval during each of a predefined number of calibration frames; and performing, during a regular adjustment phase, a regular adjustment to the flashing interval during each calibration frame until the alarm condition is no longer detected.

10. A notification appliance for signaling an alarm condition receivable from a controlling device, the notification appliance comprising:

a signal controller having a clock;

a mechanism for receiving a synchronization signal including a calibrated time position from the controlling device;

a mechanism for computing a time difference between an actual time position of the clock and the received calibrated time position from the controlling device at each predetermined time interval;

a mechanism for adjusting a preset flashing interval based on the computed time difference; and an indicating device adapted to notify persons when the notification appliance receives an alarm condition from the controlling device.

11. The notification appliance of claim 10, wherein the preset flashing interval is approximately 1 second.

12. The notification appliance of claim 10, wherein the predetermined time interval is approximately 4 seconds.

13. The notification appliance of claim 10, wherein tuning comprises:

performing a coarse adjustment to the preset flashing interval during each predetermined time interval, if the computed time difference between the actual time position and the received calibrated time position of each of the one or more notification appliances is between a range corresponding to a deviation time interval;

performing a fine adjustment to the preset flashing interval during each predetermined time interval for a predefined number of predetermined time intervals; and performing a regular adjustment to the preset flashing interval during each predetermined time interval until the alarm condition is reset.

14. The notification appliance of claim 10, wherein the indicating device is selected from the group consisting of a visual only device, an audible/visual device, and a speaker/visual device.

15. An emergency evacuation and fire safety system comprising:

a master controller;

a detector in communication with the master controller;

at least one notification appliance circuit driver in communication with the master controller, each notification appliance circuit driver having a notification appliance circuit controller having a calibrated time position for sending a synchronizing time message including a calibrated time position periodically at a predetermined time interval;

at least two notification appliances, each notification appliance unit including a signal controller having a clock, a mechanism for receiving a synchronization signal including the calibrated time position from the controlling device, a mechanism for computing a time difference between an actual time position of the clock and the received calibrated time position from the controlling device at each predetermined time interval, a mechanism for adjusting a preset flashing interval based on the computed time difference, and an indicating device adapted to notify persons when the notification appliance receives an alarm condition from the controlling device.

16. The system of claim 15, wherein the preset flashing interval is approximately 1 second.

17. The system of claim 15, wherein the predetermined time interval is approximately 4 seconds.

18. The system of claim 15, wherein tuning of each of the one or more notification appliances comprises:

performing a coarse adjustment to the preset flashing interval during each predetermined time interval, if the computed time difference between the actual time position and the received calibrated time position of each of the one or more notification appliances is between a range corresponding to a deviation time interval;

performing a fine adjustment to the preset flashing interval during each predetermined time interval for a predefined number of predetermined time intervals; and performing a regular adjustment to the preset flashing interval during each predetermined time interval until the alarm condition is reset.

19. The system of claim 15, wherein the at least one notification appliance circuit driver is at least two notification appliance circuit drivers and each notification appliance circuit driver each has at least two notification appliances.

20. A system of claim 15, wherein the one or more notification appliances are selected from the group consisting of visual only device, an audible/visual device, and a speaker/visual device.

* * * * *